US007524124B2

(12) United States Patent
Er

(10) Patent No.: US 7,524,124 B2
(45) Date of Patent: Apr. 28, 2009

(54) PAINT ROLLER FOR SELECTIVELY APPLYING PAINT AT SURFACE CORNERS

(76) Inventor: Poh Leong Er, 369 Joo Chiat Place, Singapore (SG) 428027

( * ) Notice: Subject to any disclaimer, the term of this patent is extended or adjusted under 35 U.S.C. 154(b) by 171 days.

(21) Appl. No.: 10/509,848

(22) PCT Filed: Jan. 24, 2003

(86) PCT No.: PCT/SG03/00015

§ 371 (c)(1),
(2), (4) Date: Oct. 1, 2004

(87) PCT Pub. No.: WO03/082479

PCT Pub. Date: Oct. 9, 2003

(65) Prior Publication Data

US 2005/0141950 A1 Jun. 30, 2005

(30) Foreign Application Priority Data

Apr. 1, 2002 (SG) ..... 200201815-8

(51) Int. Cl.
*B05C 17/00* (2006.01)
*B25F 5/02* (2006.01)

(52) U.S. Cl. ..... 401/197; 401/208; 401/219; 492/27

(58) Field of Classification Search ..... 401/196, 401/197, 208, 218, 219, 220; 492/27; 15/230.11
See application file for complete search history.

(56) References Cited

U.S. PATENT DOCUMENTS

| | | | | | |
|---|---|---|---|---|---|
| 1,546,529 | A | * | 7/1925 | Wuelker | 15/104.93 |
| 2,836,840 | A | | 6/1958 | Pratt | |
| 3,099,034 | A | * | 7/1963 | Leland | 401/197 |
| 3,702,739 | A | * | 11/1972 | Rentfrow | 401/197 |
| 4,196,491 | A | * | 4/1980 | Baril | 15/230.11 |
| D403,866 | S | * | 1/1999 | Lapre | D4/122 |

FOREIGN PATENT DOCUMENTS

| | | |
|---|---|---|
| BE | 542335 | 8/1959 |
| DE | 910515 | 5/1954 |

* cited by examiner

*Primary Examiner*—David J Walczak

(57) ABSTRACT

A paint roller (10) has a frustoconically-shaped applicator (12), a paint-absorbable member (14) and a movement coupler (16). The applicator (12) has a coupling portion (18) and two opposite ends (20, 22) and is rotatable at the coupling portion (18) about a rotary axis (24). The end (20) is a coupling end (20) that has a planar cross-section smaller than that of the other end (22). The coupling portion (18) is formed at the coupling end (20) and is disposed centrally thereat. The movement coupler (16) has a rotary connecting portion (40) that is detachably coupled to the applicator (12) at the coupling portion (40) that is detachably coupled to the applicator (12) at the coupling portion (18) for rotary movement about the rotary axis (24) and a pivotal connecting portion (42) that is adapted to coact with a pivot mount of a handle (not shown) for pivotal movement of the applicator (12).

16 Claims, 4 Drawing Sheets

PAINT ROLLER FOR SELECTIVELY APPLYING PAINT AT SURFACE CORNERS

FIELD OF THE INVENTION

The present invention relates to apparatus for applying fluids such as, for example, paint onto surfaces. In particular, the present invention relates to a paint roller for selectively applying paint at surface corners.

BACKGROUND OF THE INVENTION

Paint rollers for applying paint onto surfaces are known. Typically, such paint rollers have paint-absorbing surfaces that are dipped into paint containers and then rolled over surfaces that are to be painted. Another type of paint rollers has a permeable surface through which paint, stored inside such paint rollers, can flow through for application onto surfaces that are to be painted.

Generally, existing paint rollers works well for a flat surface on which only a single paint shade or color is to be applied. However, a problem arises when such paint rollers are used to apply paint at surface corners formed, for example, by two walls or between a wall and a ceiling. This is a problem because paint desired on one surface may be undesirably applied onto an adjacent surface.

Prior art paint rollers that alleviate the above problem include U.S. Pat. No. 5,623,740, issued to Burns et al., in which an apparatus provides a guard shield that acts as a barrier to paint being applied onto an adjacent surface. Such prior art paint rollers provide shield-like barriers or guards that are detachably mounted to the paint rollers. However, use of the shield-like barriers or guards causes other problems. For example, a guard may be required to contact an adjacent surface for alignment purposes as well and this is a problem when an adjacent surface has wet paint or is delicate. Consequently, the adjacent surface can be damaged by abrasion with the guard. Furthermore, shield-like barriers or guards are accessories that typically require assembling or attaching, which adds complexity to prior art paint rollers.

Therefore, a need clearly exists for a novel paint roller for selectively applying paint at surface corners and that does not need separate accessories such as a barrier or a guard to be assembled or attached.

BRIEF SUMMARY OF THE INVENTION

The present invention seeks to provide a paint roller for selectively applying paint at surface corners.

Accordingly, in one aspect, the present invention provides a paint roller comprising:

a frustoconically-shaped applicator having two opposite ends, a coupling portion disposed at one of the opposite ends, and an external surface between the two opposite ends, the frustoconically-shaped applicator being rotatable at the coupling portion about a rotary axis; and at least one paint-absorbable member mounted to the external surface.

In another aspect, the present invention provides a paint roller comprising:

a frustoconically-shaped applicator having two opposite ends, a coupling portion disposed at one of the opposite ends, and an external surface between the two opposite ends, the frustoconically-shaped applicator being rotatable at the coupling portion about a rotary axis;

at least one paint-absorbable member mounted to the external surface;

a handle having a pivot mount; and a movement coupler detachably coupled to the coupling portion and to the pivot mount.

BRIEF DESCRIPTION OF THE DRAWINGS

A preferred embodiment and alternate embodiments of the present invention are described, by way of example, with reference to the drawings of which.

DETAILED DESCRIPTION OF THE DRAWINGS

A paint roller in accordance with a preferred embodiment and an alternate embodiment of the invention are described. In the following description, details are provided to describe these embodiments. However, it shall be apparent to one skilled in the art that the invention may be practiced without such details. Some of these details may not be described at length so as not to obscure the invention.

There are many advantages of the embodiments of the invention. One advantage of the embodiments is that contact with an adjacent surface by a paint-absorbable member of the paint roller is avoided, or at least alleviated, when using the paint roller to paint a surface.

Another advantage of the embodiments of the invention is that the paint roller is simple to use and does not require an accessory such as a barrier or a guard. Without such an accessory, the likelihood of contact with an adjacent surface having wet paint or damage to the adjacent surface is avoided or reduced.

A further advantage of the invention is that the paint roller can receive paint directly onto a paint-absorbable member from an external paint container in the preferred embodiment. In an alternate embodiment, the paint roller has a chamber that stores paint and that is coupled to the paint-absorbable member via at least one paint-permeable portion.

Figure 1:
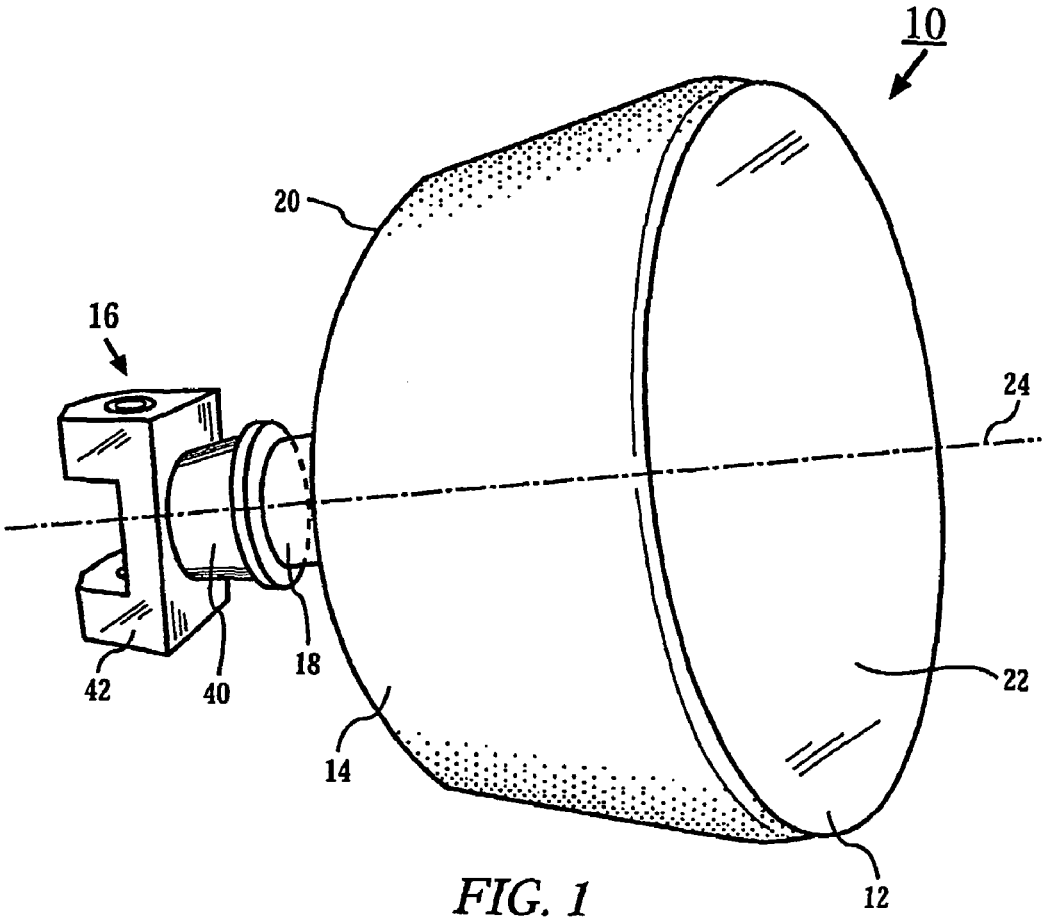
FIG. 1 is a perspective view of a paint roller comprising a frustoconically-shaped applicator and a movement coupler in accordance with the preferred embodiment.

Referring now to FIG. 1, a perspective view of a paint roller 10 in accordance with the preferred embodiment of the invention is illustrated. The paint roller 10 comprises a frustoconically-shaped applicator 12, a paint-absorbable member 14 and a movement coupler 16.

The frustoconically-shaped applicator 12 has a coupling portion 18 and two opposite ends 20,22 and is rotatable at the coupling portion 18 about a rotary axis 24. The opposite end 20 is a coupling end 20 that has a planar cross-section smaller than a corresponding planar cross-section of the other opposite end 22. The coupling portion 18 is formed at the coupling end 20 and is disposed centrally relative to the planar cross-section of the coupling end 20.

Figure 2:
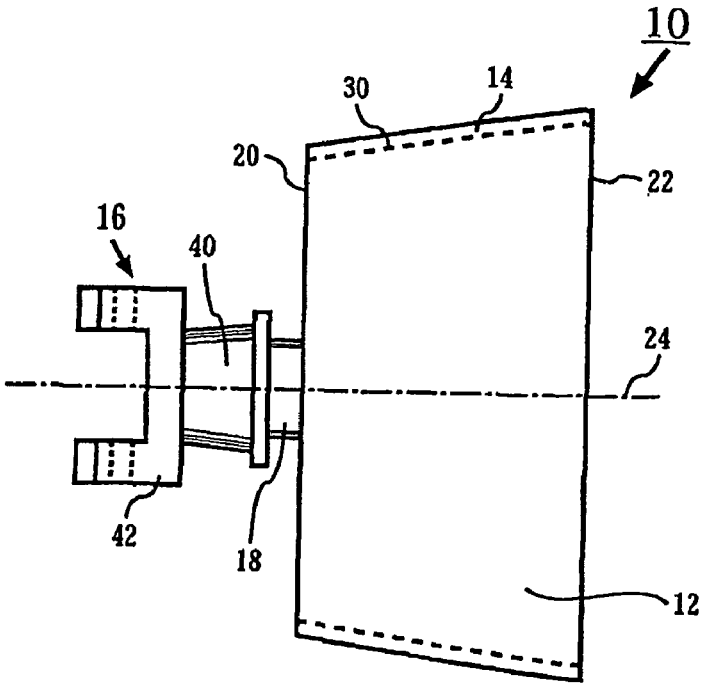
FIG. 2 is a side view of the paint roller of FIG. 1.

The paint-absorbable member 14 is mounted to an external surface 30 of the frustoconically-shaped applicator 12 between the two opposite ends 20,22. The external surface 30 is indicated in a side view of the paint roller 10 shown in FIG. 2. The paint-absorbable member 14 can be formed with foam or sponge-like material.

The movement coupler 16 is detachably coupled to the frustoconically-shaped applicator 12 at the coupling portion 18. The movement coupler 16 comprises a rotary connecting portion 40 and a pivotal connecting portion 42. The rotary connecting portion 40 is adapted to coact with the coupling portion 18 for rotary movement of the frustoconically-shaped applicator 12 about the rotary axis 24. The pivotal connecting portion 42 is adapted to coact with a pivot mount of a handle (not shown) for pivotal movement of the frustoconically-shaped applicator 12.

Figure 3:
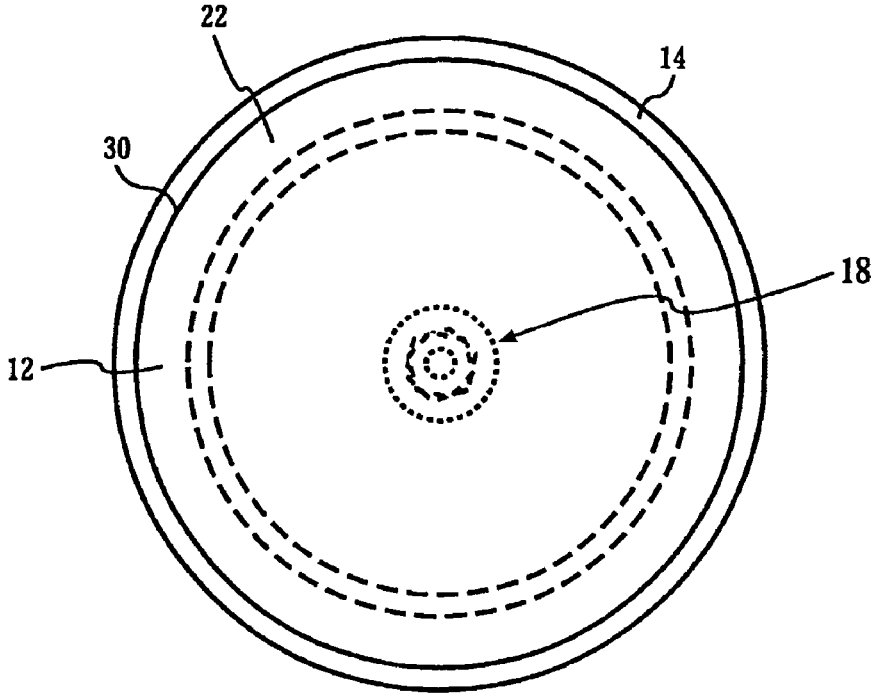
FIG. 3 is an end view of the paint roller of FIG. 1 looking at one opposite end of the frustoconically-shaped applicator.
Figure 4:
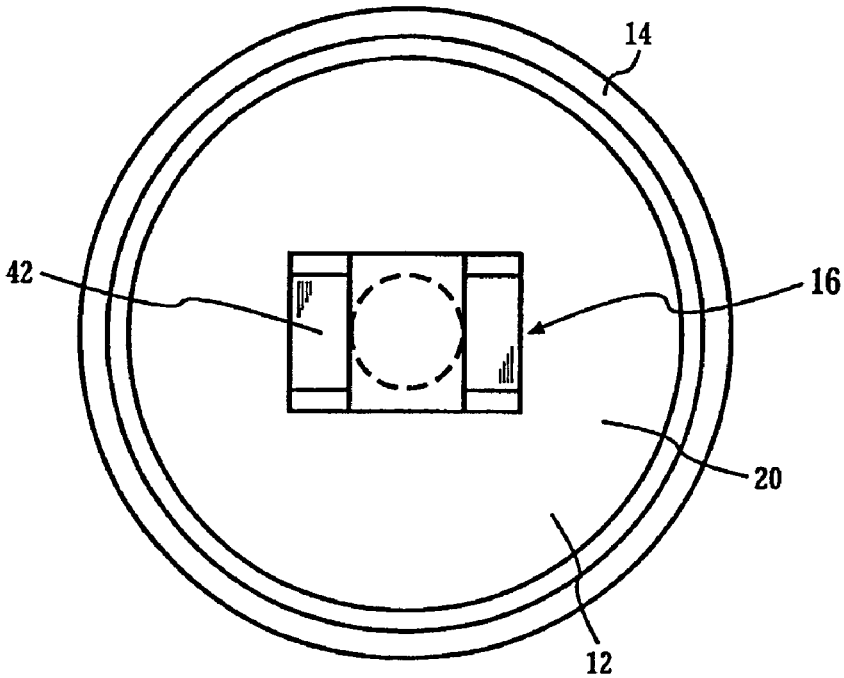
FIG. 4 is an end view of the paint roller of FIG. 1 looking at the other opposite end of the frustoconically-shaped applicator.

FIG. 3 is an end view of the paint roller 10 looking at the opposite end 22 and FIG. 4 is an end view of the paint roller 10 looking at the other opposite or coupling end 20. In these end views, disposition of the paint-absorbable member 14, the external surface 30 and the movement coupler 16 relative to each other are illustrated. In addition, these end views illustrate the planar cross-section of the two opposite ends 20,22.

Figure 5:
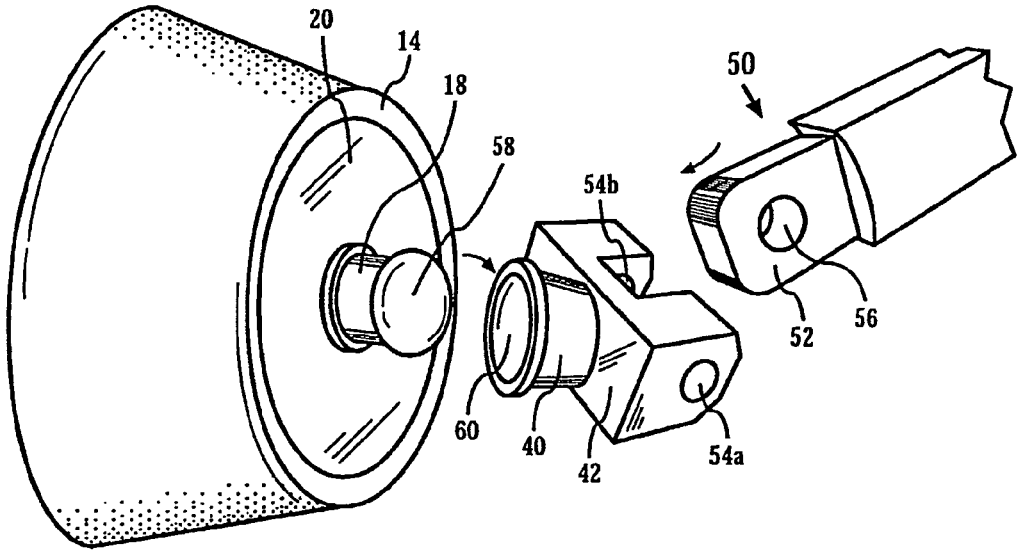
FIG. 5 is a perspective view of the paint roller of FIG. 1 with the movement coupler separated and a part of a handle for the paint roller.

Referring now to FIG. 5, a perspective view of the paint roller 10 with the movement coupler 16 separated and a part of handle 50 for the paint roller 10 is illustrated. The handle 50 has a pivot mount 52 that couples to the pivotal connecting portion 42 of the movement coupler 16. Apertures 54,56 are provided, respectively, at the pivotal connecting portion 42 and the pivot mount 52 to enable a pivot coupling thereat. With the apertures 54*a*,54*b* and a pin (not shown), the pivotal connecting portion 42 is adapted to coact with the pivot mount 52 for pivotal movement of the frustoconically-shaped applicator 12. The coupling portion 18 has a knob 58 that couples to an aperture 60 of the rotary connecting portion 40 of the movement coupler 16.

Figure 6:
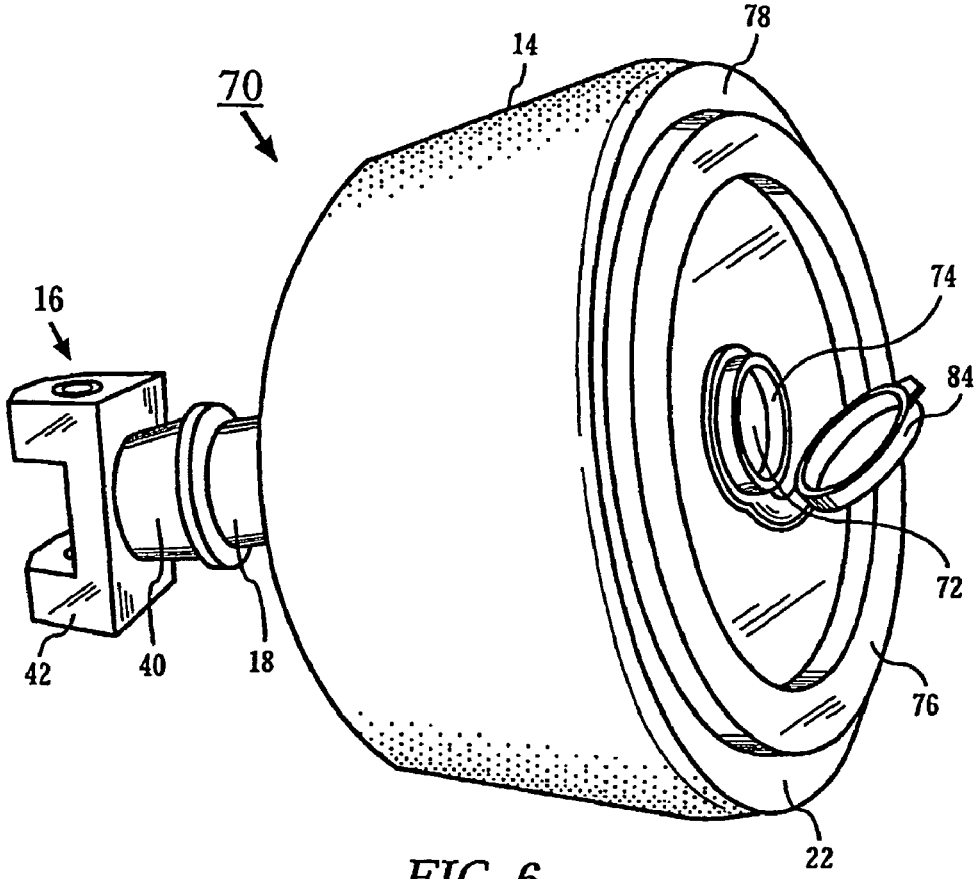
FIG. 6 is a perspective view of a paint roller in accordance with an alternate embodiment of the present invention.

A perspective view of a paint roller 70 in accordance with an alternate embodiment of the present invention is illustrated in FIG. 6. Other than elements similar to the paint roller 10, the paint roller 70 further comprises a chamber 72 for storing paint, a closable inlet 74 that leads into the chamber 72 and an abutment member 76. The abutment member 76 is mounted to the opposite end 22 and serves to alleviate contact of the paint-absorbable member 14 with adjacent surfaces that are not being painted.

Figure 7:
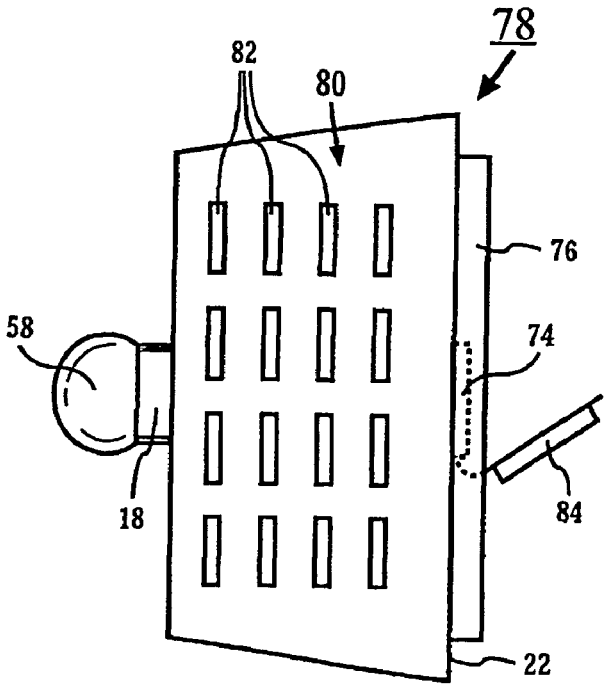
FIG. 7 is a side view of a frustoconically-shaped applicator for the paint roller of FIG. 6.

Referring to FIG. 7, a side view of a frustoconically-shaped applicator 78 for the paint roller 70 is illustrated. The frustoconically-shaped applicator 78 comprises at least one paint-permeable portion 80. In this alternate embodiment, the at least one paint-permeable portion 80 comprises slits 82 through which paint is provided to the paint-absorbable member 14 from the chamber 72. The closable inlet 74 is disposed at the opposite end 22 and has a cover 84. Paint is poured into the chamber 72 via the closable inlet 74 and the chamber 72 is then capped using the cover 84.

While the present invention has been described in detail for the above embodiments with reference to FIGS. 1 to 7, it should be understood that FIGS. 1 to 7 are illustrative of the embodiments without limiting the invention. For example, the paint-permeable portion 80 has the slits 82 oriented as shown in FIG. 7. However, other shapes and different orientation of such shapes may be provided at the paint-permeable portion 80. Also, the closable inlet 74 may be placed at other locations that do not restrict or limit movement of the frustoconically-shaped applicator 78. Furthermore, coupling between the coupling portion 18 and the movement coupler 16 may also be provided in another manner although not shown in the embodiments as described and illustrated. Accordingly, persons skilled in the art can make various modifications and improvements without departing from the spirit and the scope of the present invention.

What is claimed is:

1. A paint roller comprising:

a frustoconically-shaped applicator having one larger end and one smaller end being opposite to the one large end, a coupling portion disposed at the one smaller end, and an external surface between said two opposite ends, said frustoconically-shaped applicator being rotatable at said coupling portion about a rotary axis; said frustoconically-shaped applicator comprises a chamber for storing paint; wherein the one smaller end bearing the coupling portion has a planar cross-section smaller than the one larger end; and wherein the coupling portion receives an external handling means that extends outwardly from the coupling portion, thereby the applicator is controlled from the one smaller end;

at least one paint-absorbable member mounted to said external surface;

at least one abutment member mountable to one of said opposite ends; and a movement coupler detachably coupled to said coupling portion.

2. The paint roller as claimed in claim 1, wherein said movement coupler comprises a rotary connecting portion adapted to coact with said coupling portion for rotary movement about said rotary axis.

3. The paint roller as claimed in claim 1, wherein said movement coupler comprises a pivotal connecting portion adapted to coact with a pivot mount of a handle for pivotal movement of said frustoconically-shaped applicator.

4. The paint roller as claimed in claim 1, wherein said frustoconically-shaped applicator further comprises at least one closable inlet leading into said chamber.

5. The paint roller as claimed in claim 4, wherein said at least one closable inlet is disposed at one of said opposite ends.

6. The paint roller as claimed in claim 1, wherein said chamber comprises at least one paint-permeable portion coupled to said at least one paint-absorbable member.

7. The paint roller as claimed in claim 1, wherein said coupling portion is disposed centrally relative to said planar cross-section of said coupling end.

8. A paint roller comprising:

a frustoconically-shaped applicator having one larger end and one smaller end being opposite to the one large end, a coupling portion disposed at the one smaller end, and an external surface between said two opposite ends, said frustoconically-shaped applicator being rotatable at said coupling portion about a rotary axis; wherein the one smaller$_{13}$ end bearing the coupling portion has a planar cross-section smaller than the one larger end; and wherein the coupling portion receives an external handling means that extends outwardly from the coupling portion, thereby the applicator is controlled from the one smaller end;

at least one paint-absorbable member mounted to said external surface;

a handle having a pivot mount; and a movement coupler detachably coupled to said coupling portion and to said pivot mount.

9. The paint roller as claimed in claim 8, wherein said movement coupler comprises a rotary connecting portion adapted to coact with said coupling portion for rotary movement of said frustoconically-shaped applicator about said rotary axis.

10. The paint roller as claimed in claim 8, wherein said movement coupler comprises a pivotal connecting portion, adapted to coact with said pivot mount for pivotal movement of said frustoconically-shaped applicator.

11. The paint roller as claimed in claim 8, wherein said frustoconically-shaped applicator comprises a chamber for storing paint.

12. The paint roller as claimed in claim 11, wherein said frustoconically-shaped applicator further comprises at least one closable inlet leading into said chamber.

13. The paint roller as claimed in claim 12, wherein said at least one closable inlet is disposed at one of said opposite ends.

14. The paint roller as claimed in claim 11, wherein said chamber comprises at least one paint-permeable portion coupled to said at least one paint-absorbable member.

15. The paint roller as claimed in claim 8, wherein said coupling portion is disposed centrally relative to said planar cross-section of said coupling end.

16. The paint roller as claimed in claim 8, and further comprising at least one abutment member mountable to one of said opposite ends.

* * * * *